US007241186B1

(12) United States Patent
Lin

(10) Patent No.: US 7,241,186 B1
(45) Date of Patent: Jul. 10, 2007

(54) VEHICLE LIGHTING SOURCE ADAPTER

(76) Inventor: Yu-Chu Lin, No. 477, Chung Shan N. Rd., Yung Kang City, Taipei Hsien (TW)

( * ) Notice: Subject to any disclaimer, the term of this patent is extended or adjusted under 35 U.S.C. 154(b) by 0 days.

(21) Appl. No.: 11/532,807

(22) Filed: Sep. 18, 2006

(51) Int. Cl.
*H01R 13/432* (2006.01)

(52) U.S. Cl. ..... 439/746; 439/36; 439/660

(58) Field of Classification Search ..... 439/36, 439/871, 869, 751, 872–873, 746, 660, 336, 439/356, 702, 918, 699.2, 619, 625, 357–358
See application file for complete search history.

(56) References Cited

U.S. PATENT DOCUMENTS 4,371,227 A * 2/1983 Yosimura ..... 439/746
5,314,347 A * 5/1994 Colleran et al. ..... 439/358

* cited by examiner

*Primary Examiner*—Felix O. Figueora
(74) *Attorney, Agent, or Firm*—WPAT, P.C.; Anthony King

(57) ABSTRACT

A vehicle lighting source adapter includes a holder, terminals, and cables connected to the terminals. The holder has a pair of insertion blocks at both sides and an insertion plate at a front end. The insertion plate includes an upper surface and a lower surface. Each of the upper and lower surfaces is disposed with a pair of connection channels. Each connection channel includes a first and a second fillisters. A retainer is disposed to each of the first and second fillisters. Each terminal is inserted into and partially exposed from the first fillister and has its snap portion restricted by the retainer.

3 Claims, 3 Drawing Sheets

VEHICLE LIGHTING SOURCE ADAPTER

BACKGROUND OF THE INVENTION (a) Field of the Invention

The present invention relates to a vehicle lighting source adapter, and more particularly, to a holder provided with insertion blocks at both sides and an insertion plate at its front end, and the insertion plate is disposed with connection channels to receive insertion of terminals.

(b) Description of the Prior Art

Among those vehicle lighting fixtures generally available in the market, LED (light-emitting diode) becomes the most popular today. However, the LED is not compatible with the conventional lamp holder and the vehicle lamp contacts must be revised.

An adapter of the prior art has a flat and straight metal terminal fixed to a holder while the holder is inserted into the lamp holder with the terminal from the lamp holder abutted to that from the holder in a fashion of local plane. Therefore, minute spacing does exist between the terminals due to the process allowances respectively of the adapter holder and the vehicle lamp holder. Consequently, there is the imprecise abutting between both terminals, leading further to a broken circuit due to poor contact.

SUMMARY OF THE INVENTION

The primary purpose of the present invention is to provide a vehicle lighting source adapter to solve the problem of broken circuit due to poor contact.

To achieve the purpose, the present invention includes a holder, terminals and cables. The holder comprises a pair of insertion blocks at both sides and an insertion plate at a front end thereof. Each insertion block is inclined towards its outer end. The insertion plate includes an upper surface and a lower surface. Each of the upper and lower surfaces is disposed with a pair of connection channels. Each connection channel includes a first and a second fillisters with both in parallel with each other and partially connected through each other. A retainer is disposed to each fillister at where both fillisters are connected through. The retainer is a shoulder portion. A snap portion is disposed to each terminal and is inclined towards its outer end. The terminal is partially inserted into and partially exposed from the first fillister with its snap portion restricted by the retainer. The cable is connected to the terminal.

Accordingly, when the second fillister of the connection channel of the holder receives the insertion of a terminal of a lamp holder from a vehicle, the terminal of the lamp holder and the snap portion of the terminal of the holder are abutted to each other to minimize the incidence of broken circuit due to poor contact.

DETAILED DESCRIPTION OF THE PREFERRED EMBODIMENTS

Figure 1:
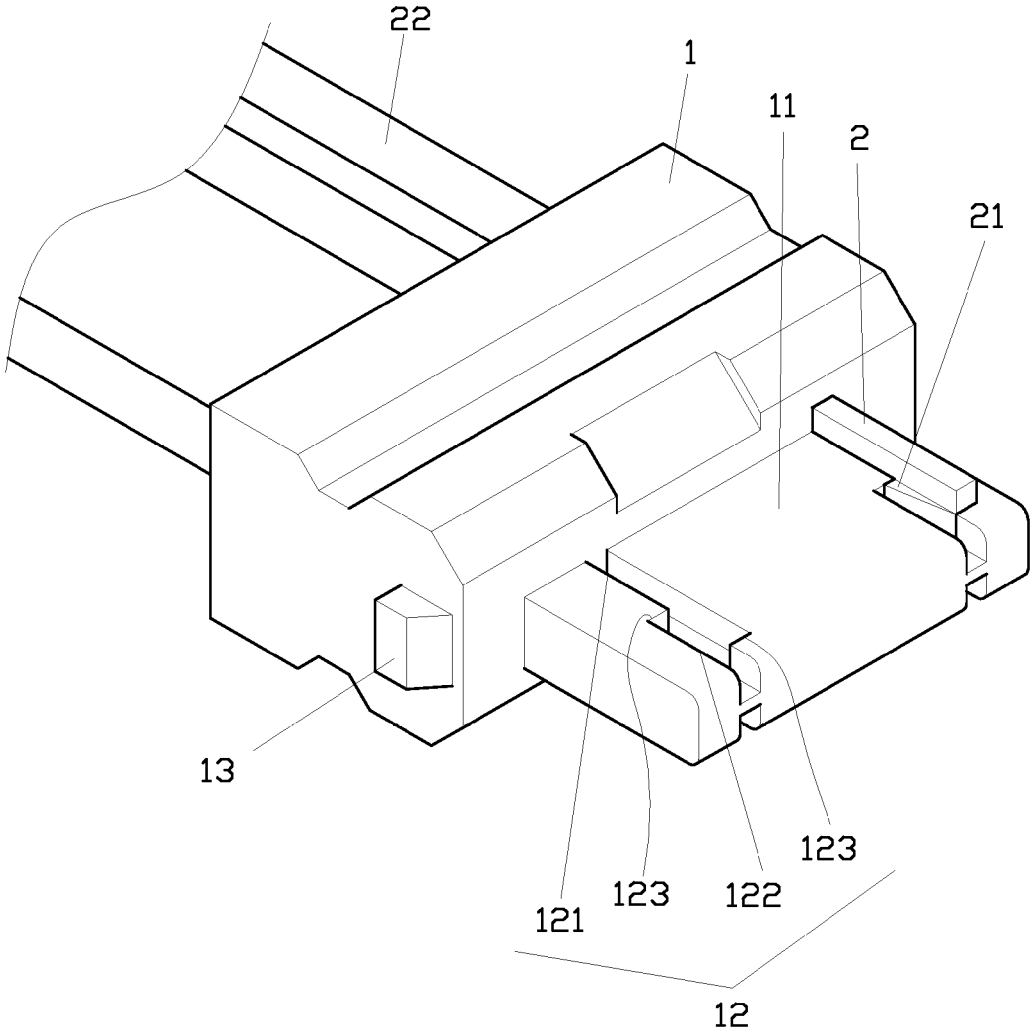
FIG. 1 is a perspective view of a preferred embodiment of the present invention.

Referring to FIG. 1, a preferred embodiment of the present invention comprises a holder (1) and terminals (2).

The holder (1) comprises a pair of insertion blocks (13) at its both sides and an insertion plate (11) at its front end thereof. Each insertion block (13) is inclined towards to its outer end. The insertion plate (11) includes an upper surface and a lower surface. Both the upper surface and the lower surface are disposed with a pair of connection channels (12). Each connection channel (12) includes a first fillister (121) and a second fillister (122). Both the first and second fillisters (121, 122) are arranged in parallel with each other and partially connecting through each other. A retainer (123) and a terminal wall (124) are disposed where both fillisters are connected through. The retainer (123) is a shoulder portion.

Each terminal (2) is disposed with a snap portion (21). The snap portion (21) is inclined towards to its outer end. A cable (22) is connected to the back of each terminal (2). The terminal (2) is inserted into and partially exposed from the first fillister (121) and the snap portion (21) is restricted by the retainer (123).

Figure 2:
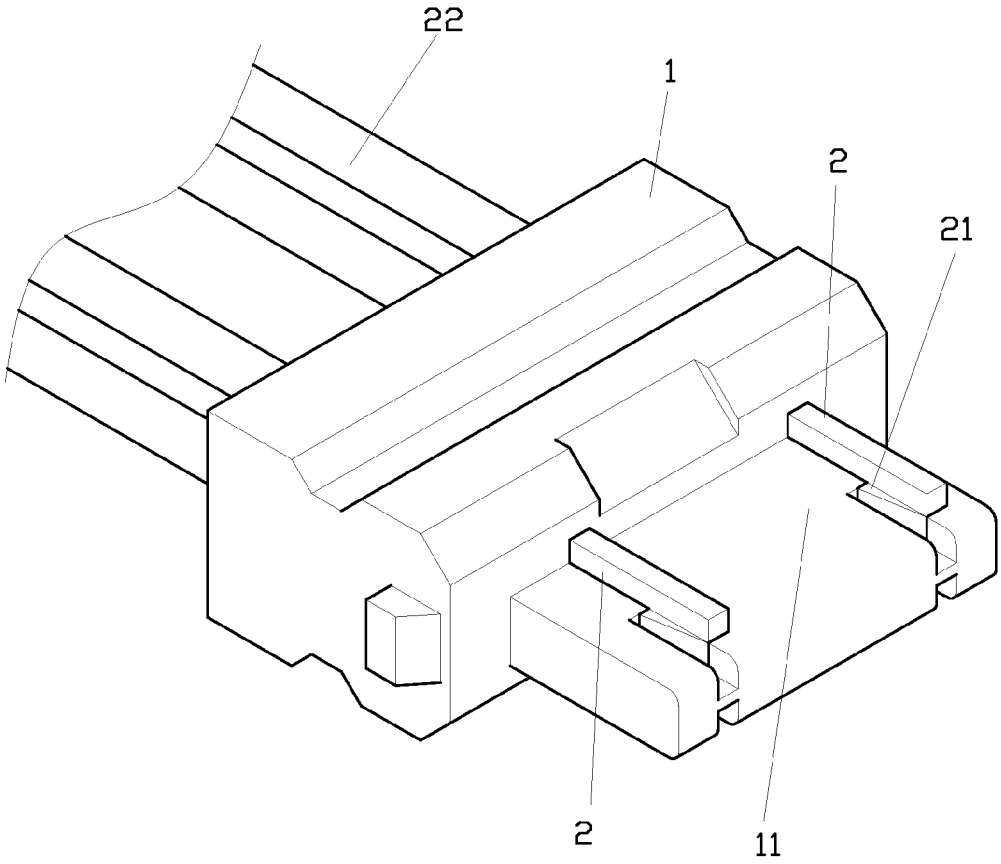
FIG. 2 is a perspective view of another preferred embodiment of the present invention.

As illustrated in FIG. 1, three terminals (2) are disposed at the holder (1) only one terminal (2) is visible while the other two terminals (2) beneath the insertion plate (11) are blocked out of sight. Each terminal (2) at its back is connected with the cable (22). In another preferred embodiment of the present invention as illustrated in FIG. 2, the holder (1) is provided with four terminals (2) only two terminals (2) are visible while the other two beneath the insertion plate (11) are blocked out of sight. Each terminal (2) at its back is connected with a cable (22). Both preferred embodiments feature the identical construction with the only difference in that one more terminal (2) is disposed to another preferred embodiment illustrated in FIG. 2. Providing only two terminals to the holder (1) is also feasible with both terminals (2) either provided on one side or respectively on both sides of the insertion plate (11).

Figure 3:
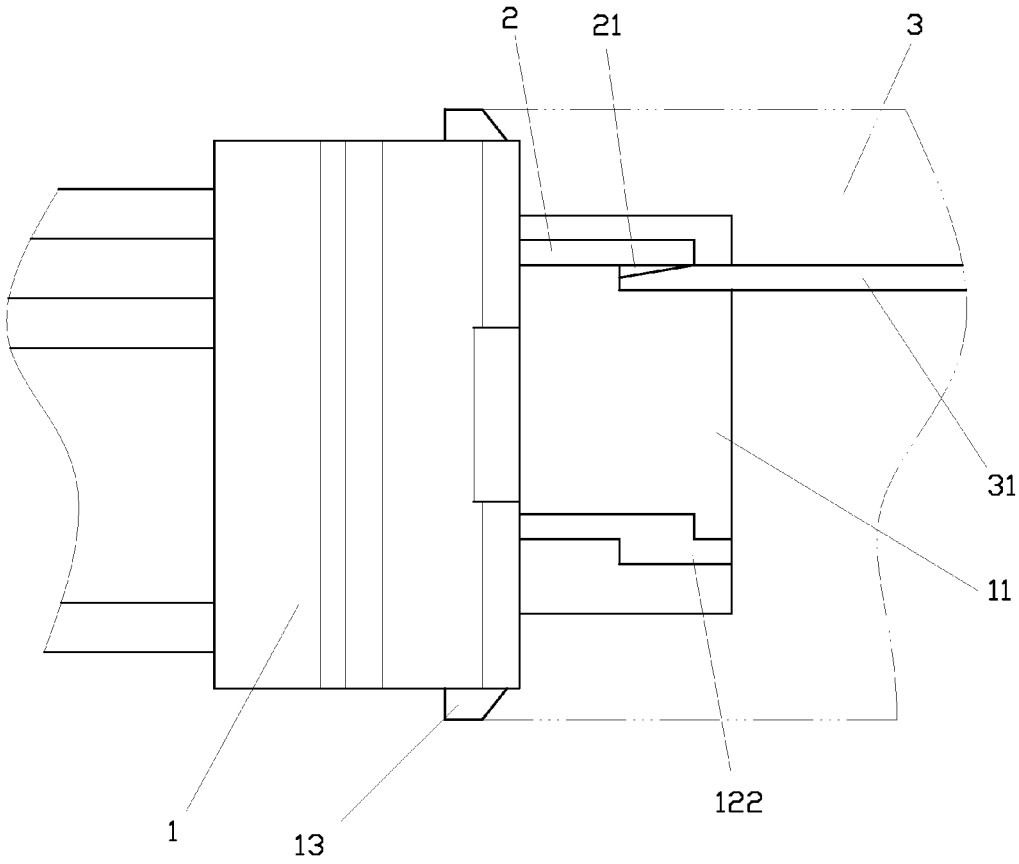
FIG. 3 is a schematic view showing that the present invention is inserted to a lamp holder.

In practice, as illustrated in FIG. 3, the insertion plate (11) of the holder (1) is inserted into a lamp holder (3) of a vehicle. The insertion blocks (13) and the snap portions (21) are inclined towards their outer ends respectively to facilitate the insertion of the lamp holder (3) and its terminals (31). Meanwhile, the lamp holder (3) is prevented from escaping due to inverse locking executed by the insertion blocks (13). The second fillister (122) of the holder (1) secures the terminal (31) of the lamp holder (3) in position. Both positive and negative poles of the terminal (31) are restricted by the second fillister (122) of the holder (1) to force the terminal (31) must be held against by the snap portion (21) of the terminal (2) thus to realize tight contact with the terminal (2) and thus the electric connection to effectively minimize the incidence of broken circuit due to poor contact. Furthermore, the lamp holder (3) is prevented from displacement through the tight insertion executed by the insertion blocks (13).

What is claimed is:

1. A vehicle lighting source adapter, comprising:

a holder having a longitudinal axis parallel to an insertion direction, the holder comprising first insertion block on a first lateral side and second insertion block on a second lateral side, and an insertion plate protruding in the insertion direction towards a front end thereof, each insertion block being inclined relative to the longitudinal axis, the insertion plate including an upper surface and a lower surface, each of the upper and lower surfaces being disposed with a pair of connection channels, each connection channel including a first fillister having a first longitudinal wall parallel to the longitudinal axis, and a second fillister having a second longitudinal wall being offset in the insertion direction and in a transverse direction from the first longitudinal wall, both the first and second fillisters being parallel with each other and partially connected through each other, a retainer being disposed at a back end of the second fillister, and a terminal wall closing off the first fillister at the front end;

terminals, each terminal being inserted into the first fillister and disposed with a snap portion, the snap portion being inclined relative to the longitudinal axis and restricted by the retainer;

cables, each cable being connected to a respective terminal;

wherein the terminal wall is disposed at a substantially right angle to the first longitudinal wall; and wherein the second longitudinal wall extends beyond the terminal wall towards the front end so that the second fillister is open at the front end.

2. The vehicle lighting source adapter as claimed in claim 1, wherein the retainer is made in a form of a shoulder.

3. The vehicle lighting source adapter as claimed in claim 1, wherein each of the terminals is inserted into and partially exposed from the first fillister.

* * * * *